US006340059B1

(12) United States Patent
Bethea

(10) Patent No.: US 6,340,059 B1
(45) Date of Patent: Jan. 22, 2002

(54) THREADLESS SPRINKLER HEAD ASSEMBLY

(76) Inventor: Warren C. Bethea, 2711 Willena Ave., Montgomery, AL (US) 36107

( * ) Notice: Subject to any disclaimer, the term of this patent is extended or adjusted under 35 U.S.C. 154(b) by 0 days.

(21) Appl. No.: 09/567,682

(22) Filed: May 9, 2000

(51) Int. Cl.[7] ..... A62C 37/08

(52) U.S. Cl. ..... 169/37; 169/16; 239/600; 285/198

(58) Field of Search ..... 239/280, 280.5, 239/281, 282, 283, 600; 169/37, 5, 16, 17, 18, 19, 38, 39, 40, 41, 90; 285/198, 197; 137/317, 318

(56) References Cited

U.S. PATENT DOCUMENTS 4,699,217 A * 10/1987 McLennan et al. ..... 169/37
4,960,546 A * 10/1990 Tharp ..... 285/197
5,149,144 A * 9/1992 Blakeley ..... 285/197
5,169,177 A * 12/1992 McLennan et al. ..... 285/197
5,199,749 A * 4/1993 Corcoran ..... 285/197

* cited by examiner

*Primary Examiner*—Lesley D. Morris
*Assistant Examiner*—Dinh Q. Nguyen
(74) *Attorney, Agent, or Firm*—Kenneth M. Bush; Sirote & Permutt, P.C.

(57) ABSTRACT

A sprinkler head mounting assembly for attaching a sprinkler head to a fluid distribution pipe, wherein the sprinkler head mounting assembly comprises a sprinkler head stem connected to the sprinkler head, a flange connected to the sprinkler head stem, a first clamp portion designed to fit around a section of the peripheral surface of the pipe and to engage the flange to affix the sprinkler head to an opening in the pipe, and a second clamp portion designed to fit around the section of the peripheral surface of the pipe that is not covered by the first clamp portion, wherein the second clamp portion designed to engage the first clamp portion to form a substantially secure connection about the pipe.

15 Claims, 4 Drawing Sheets

THREADLESS SPRINKLER HEAD ASSEMBLY

FIELD OF THE INVENTION

The present invention relates to a fluid transfer system, and more particularly, to a fluid transfer system having sprinkler heads attached to a fluid distribution pipe whereby the sprinkler heads may be attached to the pipe without the use of screw threads.

BACKGROUND OF THE INVENTION

Sprinkler heads or spray nozzles are used in a variety of industrial, agricultural, and commercial applications in which it is necessary to space multiple sprinkler heads at intervals along a fluid distribution pipe. Examples of prior art sprinkler head assemblies are discussed herein, with references made to prior art figures FIG. 6*a* and FIG. 6*b*. In determining placement of the sprinkler heads, the distribution pipes 1 are typically first cut into predetermined lengths based on the dimensions of the structure in which the fluid transfer system is to be installed and then holes are cut through the pipe sidewalls at predetermined intervals. The pipe ends are typically externally threaded or grooved for purposes of subsequent installation in the structure. A pipe fitting 2 is typically welded to the distribution pipe 1 about each hole such that the longitudinal axis through each pipe fitting is substantially perpendicular to the longitudinal axis through the distribution pipe (see FIG. 6*a*). Accordingly, the passageway in each pipe fitting 2 is in fluid communication with the passageway in the distribution pipe 1 through the hole in the pipe. After the distribution pipes 1 with attached pipe fittings 2 have been properly prepared, the pipes are delivered to the installation site.

During installation of the fluid transfer system, the distribution pipes 1 are commonly interconnected by pipe coupling members 3 having ends which are internally threaded or grooved. The pipe coupling members 3 can be, for example, linear, T-shaped, X-shaped, or L-shaped, depending on the number of distribution pipes 1 to be joined at any particular junction. Thus, the distribution pipe ends are simply screwed into the coupling members or attached with groove fittings. After the distribution pipes 1 are installed, the sprinkler heads 4 are screwed into the pipe fittings 2. Each pipe fitting 2 is typically internally threaded for receiving an externally threaded extension member 5 formed at one end of each sprinkler head 4. The sprinkler heads 4 are typically not attached to the pipe fittings 2 until the distribution pipes 1 are installed in the structure to prevent damage to the sprinkler heads during shipping and handling. For example, fire sprinkler heads having fusible links should only be attached to the pipe fittings after installation because the fusible links are fragile and susceptible to displacement during shipping and handling.

In an alternate embodiment (see FIG. 6*b*), the pipe coupling members 3 can be cast such that the coupling members include an extension 6 equivalent to the pipe fittings 2. In this embodiment, the distribution pipes 1 are typically short segments and the pipe coupling members 3 are installed between distribution pipe segments at each interval where a sprinkler head 4 is required. Accordingly, a section of distribution pipe 1 is installed, followed by a pipe coupling member 3 with extension 6, then another section of distribution pipe 1, then another pipe coupling member 3 with extension 6, and so on. After the distribution pipes 1 and pipe coupling members 3 with extensions 6 have been properly prepared, the items are delivered to the installation site. As in the previously described embodiment, after the distribution pipes 1 are installed, the sprinkler heads 4 are screwed into the internally threaded extensions 6 of the pipe coupling members 3.

Problems with these prior art embodiments include the expense of using pipe fittings 2 or casting pipe coupling members 3 with extensions 6, and the time and expense associated with threading the pipe fittings 2 or pipe coupling member extensions 6, welding the pipe fittings 2 to the distribution pipes 1, threading the extension members 5 of the sprinkler heads 4, and screwing the sprinkler heads 4 into the pipe fittings 2 or pipe coupling member extensions 6.

Other problems include the time and expense associated with on-site removal of the sprinkler heads 4 from the pipe fittings 2 or pipe coupling member extensions 6 for cleaning, inspection, relocation, or replacement. For relocating sprinkler heads 4, present assemblies require the sprinkler heads 4 be unscrewed from the pipe fittings 2 or extensions 6 and replaced with caps to seal the openings through the pipe fittings or extensions. Then, to relocate or add sprinkler heads 4, present assemblies require holes be cut in the distribution pipes 1 and threaded pipe fittings 2 be welded about the holes, a process which incurs an additional expense due to the requirement of specialists in the field, after which, the sprinkler heads 4 can be screwed into the pipe fittings 2.

Accordingly, what is needed is a sprinkler head assembly that overcomes the foregoing problems encountered with prior art sprinkler head assemblies.

SUMMARY OF THE INVENTION

It is therefore an object of this invention to provide a sprinkler head assembly that provides for quick and easy on-site installation, relocation, and removal of the sprinkler head.

It is another object of this invention to provide a sprinkler head assembly that eliminates the need for pipe fittings and thereby the time and expense associated therewith.

It is another object of this invention to provide a sprinkler head assembly that eliminates the need for casting pipe coupling members with extensions and thereby the time and expense associated therewith.

It is another object of this invention to provide a sprinkler head assembly that eliminates the need for threading the extension members of the sprinkler heads.

It is another object of this invention to provide a sprinkler head assembly for attaching a sprinkler head to a distribution pipe, the pipe having at least one opening in its peripheral surface such that fluid may flow through the pipe and be distributed through the opening and expelled through the sprinkler head attached to the opening. The sprinkler head includes an extension member or stem connected to the sprinkler head, the stem having an appropriate size to fit into the opening in the peripheral surface of the pipe substantially perpendicular to the longitudinal axis of the pipe, and the stem being sufficient to deliver fluid from the pipe to the sprinkler head.

It is another object of this invention to provide a means for securing the sprinkler head to the distribution pipe. One such securing means includes a flange connected to the sprinkler head stem, a first clamp portion substantially curved to approximate the curvature of the pipe so that the first clamp portion will fit around a section of the peripheral surface of the pipe, an opening within the first clamp portion whereby the flange is secured such that the first clamp portion may be used to affix the sprinkler head to the opening of the pipe, and a second clamp portion being designed to fit around the section of the peripheral surface of the pipe that is not covered by the first clamp portion, with the second clamp portion being connectable to the first clamp portion to form a substantially secure connection.

These and other objects and advantages of the invention will become apparent from the following detailed description of the preferred embodiment of the invention.

DETAILED DESCRIPTION OF THE INVENTION

While the invention has been shown and will be described in some detail with reference to specific exemplary embodiments, there is no intention that the invention be limited to such detail. On the contrary, the invention is intended to include all modifications, alternatives and equivalents which may fall within the spirit and scope of the invention as recited in the appended claims.

Figure 1:
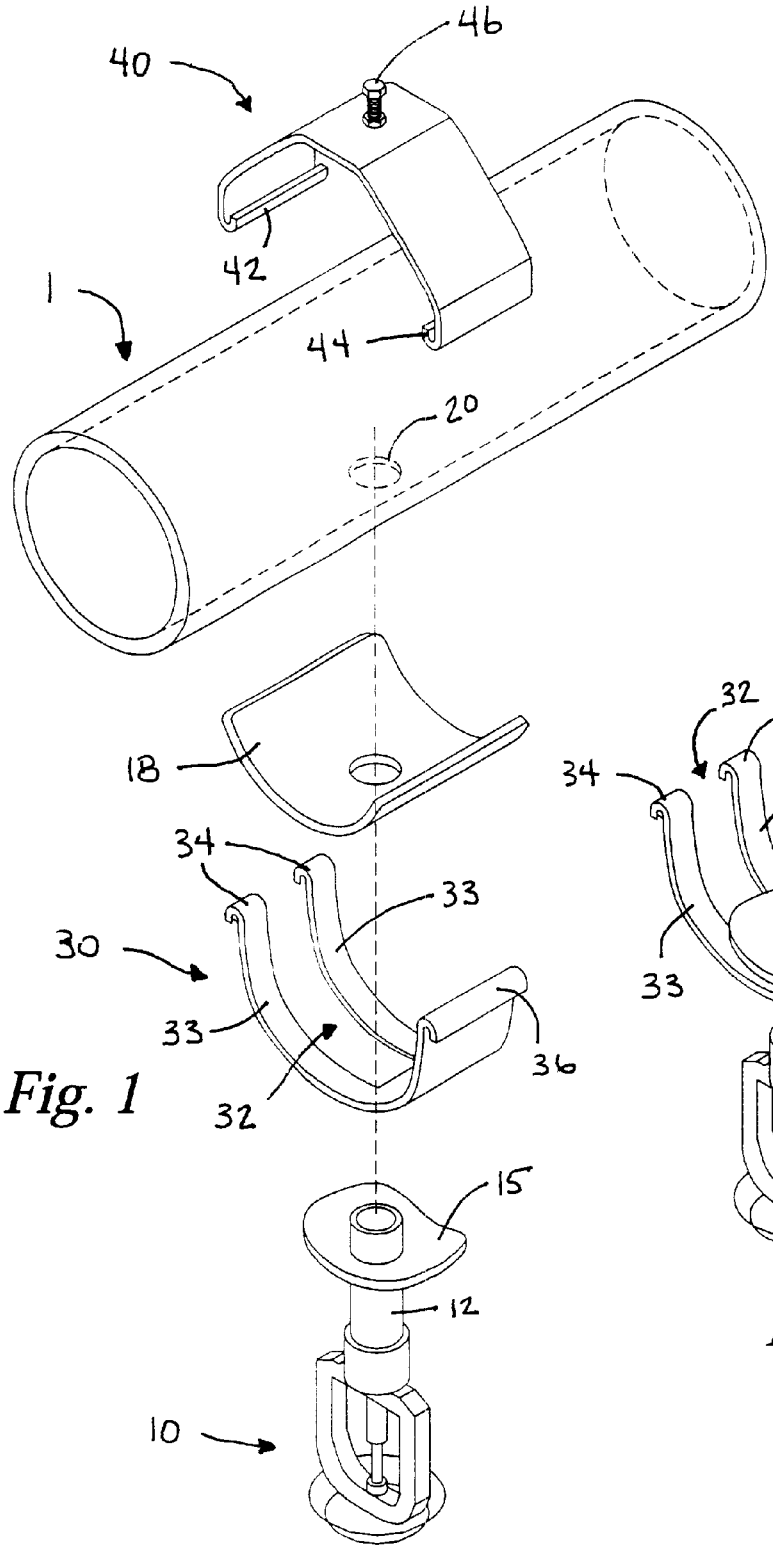
FIG. 1 is an exploded perspective view of the preferred sprinkler head assembly embodying the present invention.
Figure 2:
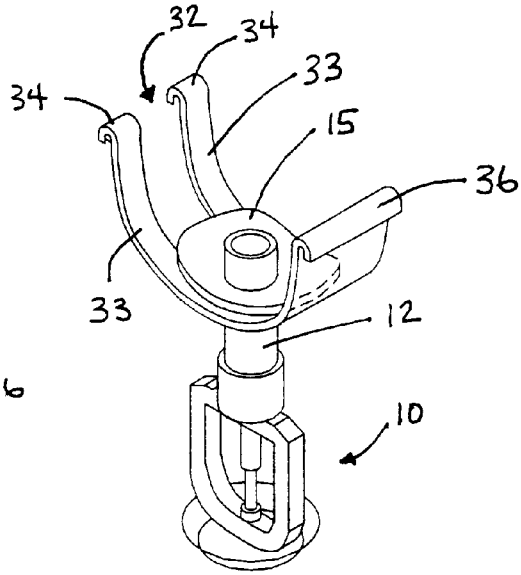
FIG. 2 is the lower portion of the sprinkler head assembly shown in FIG. 1 wherein the flange is shown within the lower clamp portion.
Figure 3:
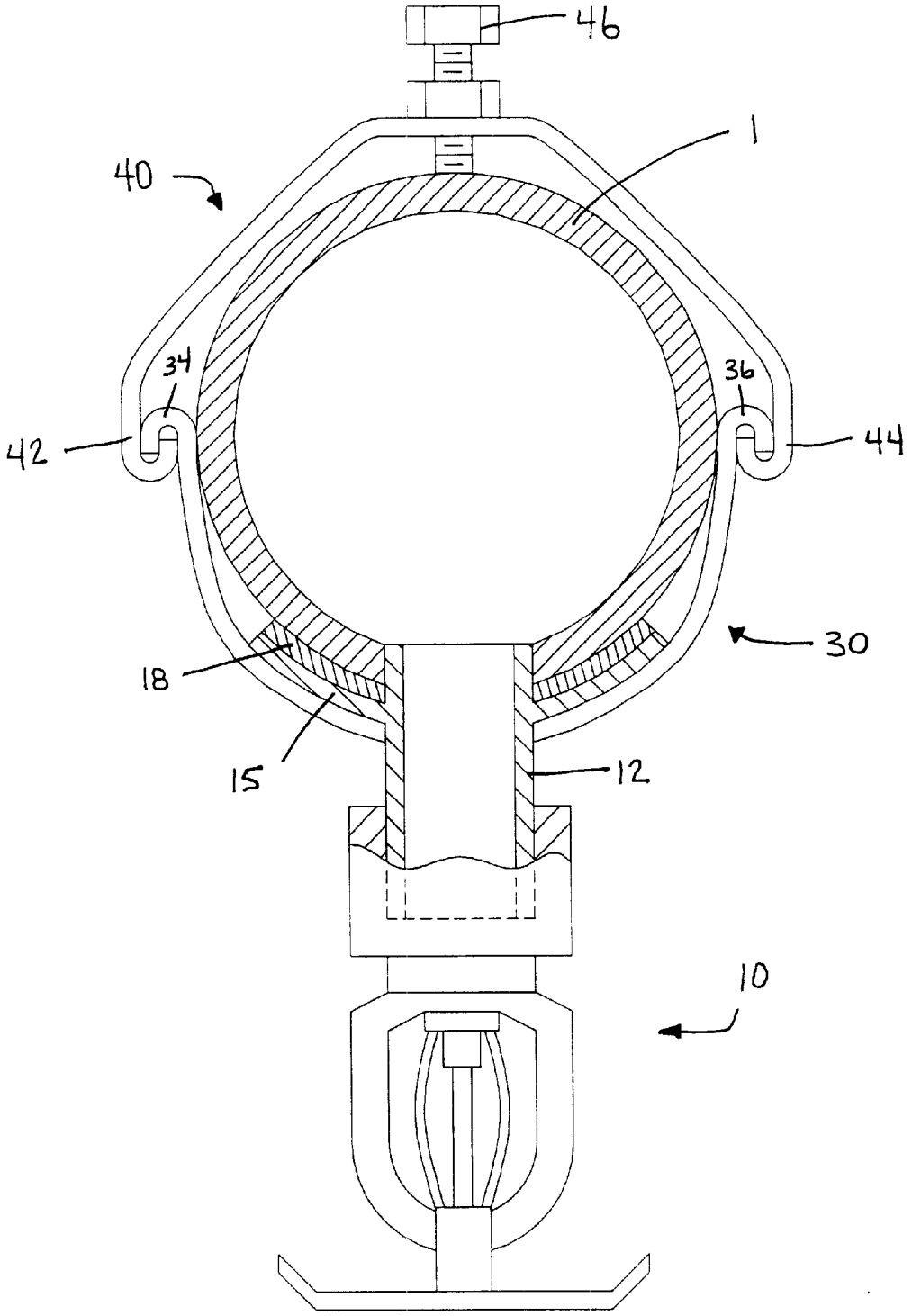
FIG. 3 is a cross-sectional view of the sprinkler head assembly embodying the present invention, fully assembled with the fluid distribution pipe.

Turning now more particularly to FIGS. 1–3 of the drawings, the preferred embodiment of the threadless sprinkler head assembly is shown. The sprinkler head assembly comprises a sprinkler head 10 having a stem 12 extending therefrom, the stem acting as a conduit to carry water or other fluid from the pipe 1 to the sprinkler head 10. The sprinkler head may be any type of commonly used sprinkler heads used in the industry for a wide variety of purposes. The stem 12 of the sprinkler head is intended to fit into a hole 20 cut through the peripheral surface of the pipe 1. In this regard, the diameter of hole 20 is preferably only slightly larger than the outside diameter of stem 12 to reduce the threat of fluid leakage. The stem 12 and hole 20 are preferably threadless since the primary objective of this invention is to secure the sprinkler head 10 and stem 12 to the pipe 1 and hole 20 without the use of threaded screw attachments or welding. Once the sprinkler head 10 is in place, then pressurized fluid may be run longitudinally through pipe 1 such that some of the fluid will flow down stem 12 and be expelled through the spray nozzle of sprinkler head 10.

For the purpose of securely mounting the sprinkler head 10 to the pipe 1, a first clamping element 30 is fitted around the sprinkler head stem 12. As show in FIGS. 1 and 2, the preferred embodiment of the first clamping element 30 provides a slot 32 which is substantially the same width as the outside diameter of stem 12. The slot 32 allows for the first clamping element 30 to be easily slipped into place around the exterior of stem 12. Flange 15 is attached to stem 12, which enables the extended portions 33 of the first clamping element 30 to engage flange 15 in order to hold the sprinkler head 10 in abutment with pipe 1. Flange 15 is preferably substantially curved to match the curvature of the pipe 1, which will assist in providing a secure fit. Other means for connecting first clamping element 30 and stem 12 are easily envisioned. For example, first clamping element 30 may be designed with a hole rather than slot 32 and will still secure the sprinkler head 10 to the pipe 1 by engaging flange 15, or the first clamping element 30 may be attached to stem 12 in the manufacturing, and simply replace flange 15.

Once the first clamping element 30 is in place around stem 12, then the sprinkler head 10 may be secured to pipe 1 by joining the first clamping element 30 to the second clamping element 40. An O-ring or gasket 18 is preferably placed around stem 12 to prevent leakage and then stem 12 is placed within hole 20. Care should be taken that stem 12 does not extend too far into the interior of pipe 1, or the intended flow of fluid into the stem 12 may be hampered. Flange 15 is preferably placed at an interval along stem 12 such that it and the optional gasket 18 keep stem 12 from extending too far into hole 20, while still providing a secure connection to the pipe. Flange 15 can be designed to fit a range of pipes having different diameters and the gaskets 18 can be designed in a variety of shapes and thicknesses to accommodate the flange 15 to a particular size pipe.

As shown in FIGS. 1 and 2, first clamping element 30 is substantially the same shape as one portion of the pipe 1. This allows the ends 34, 36 of the first clamping element 30 to extend along the pipe contour (see FIG. 3). The first clamping element ends 34, 36 will then be connected with the ends 42, 44 of a second clamping element 40 to secure the sprinkler head 10 to the pipe 1. As shown in FIGS. 1 and 3, the preferred means for connecting the first and second clamping elements 30, 40 is the use of a hook connection, wherein the ends of one clamping element hook outward, and the ends of the other clamping element hook inward. In FIGS. 1 and 3, ends 34 and 36 hook outward while ends 42 and 44 hook inward. Such hook connections are preferred because they are easy to assemble in the field, and yet become quite sturdy once stress is added to the hook ends, causing them to grip tightly. In the preferred embodiment, stress is added to the hook connections by means of a set screw 46 within the second clamping element 40. The set screw 46 is preferably in the approximate center of second clamping element 40, so that it provides equal stress to both end connections. The set screw braces against the peripheral surface of pipe 1. As the set screw is "tightened" against the pipe 1 peripheral surface, the portion of the second clamping element 40 adjacent the set screw will move further away from the pipe surface. This movement of the second clamping element 40 will create stress in the hook connections, and thereby firmly secure the entire assembly in place.

FIG. 3 shows a cross section of the entire assembly of the preferred embodiment of the present invention. In FIG. 3, set screw 46 has been tightened sufficiently so that gasket 18 and flange 15 are held securely against the peripheral surface of the pipe 1, thereby allowing fluid to reach the sprinkler head 10 while preventing leakage. The amount of stem 12 that will extend through hole 20 may vary depending upon the application.

Figure 4:
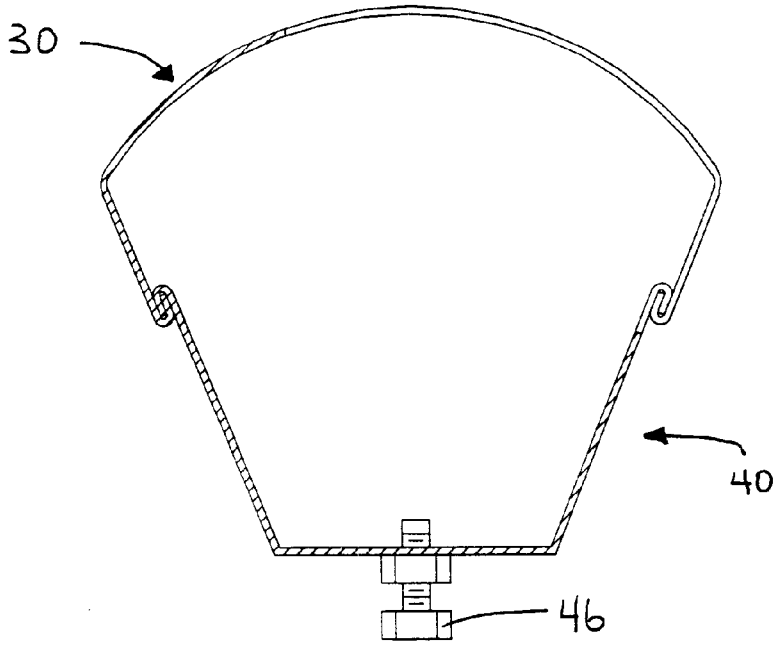
FIG. 4 is a cross-sectional view of a clamp assembly of the preferred embodiment of the present invention.

FIG. 4 shows a cross section of the preferred clamping assembly described above in the absence of the pipe 1 and sprinkler head 10. As can bee seen in FIG. 4, first clamping element 30 is preferably curved to approximate the shape of pipe 1 and thereby provide a secure fit for the sprinkler head 10. The second clamping element 40 is more angular, to provide proper stress to the preferred hook connections of the clamping element ends. One of skill in the art will readily notice other possible shapes for the clamping elements, and perhaps alter the configuration to provide more than two clamping elements in the assembly.

Figure 5:
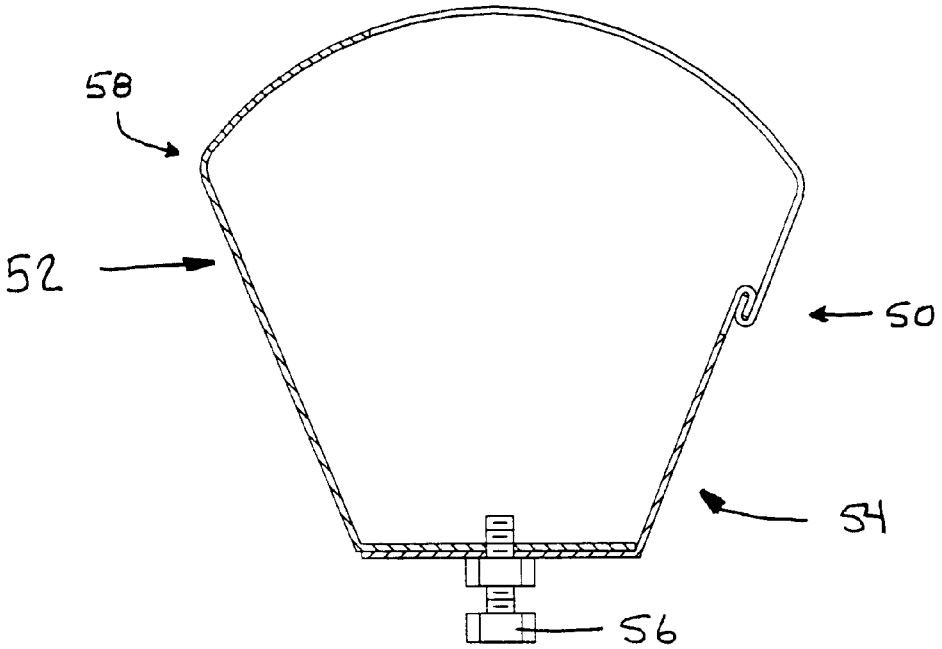
FIG. 5 is cross-sectional view of an alternative embodiment of the clamp assembly of the present invention.
Figure 6A:
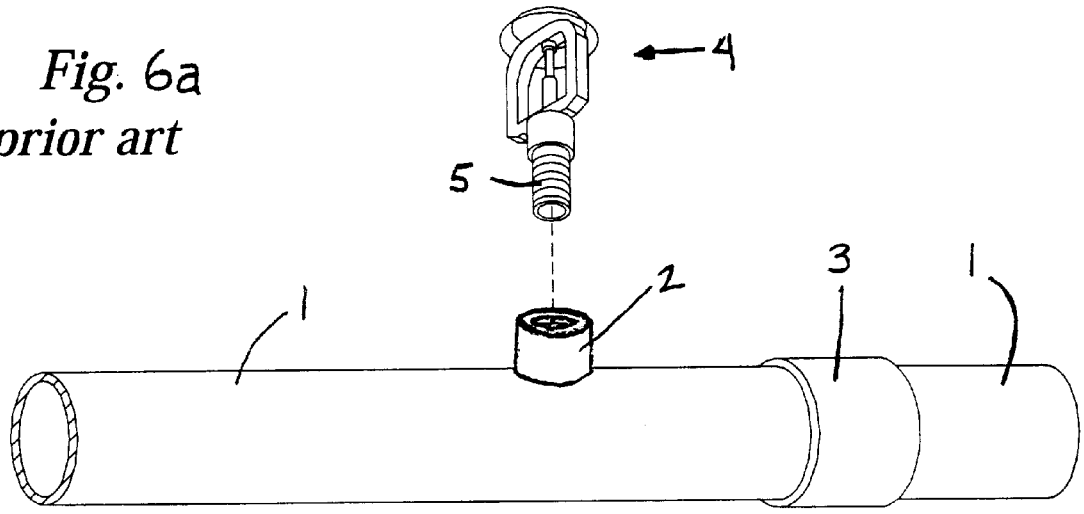
Fig. 6a prior art
FIG. 6*a* is a partially exploded perspective view of a prior art sprinkler head connection wherein the sprinkler head is attached to a fluid distribution pipe.
Figure 6B:
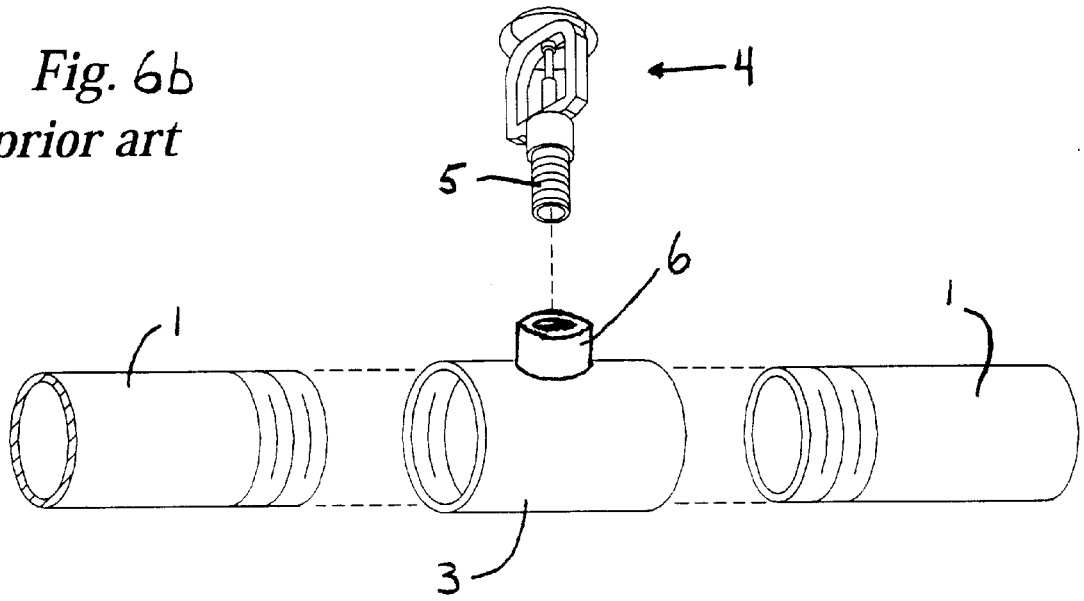
Fig. 6b prior art
FIG. 6*b* is a partially exploded perspective view of a prior art sprinkler head connection wherein the sprinkler head is attached to a pipe coupling member.

FIG. 5 shows a cross section of an alternative clamping assembly. In this embodiment, the clamping assembly has just a single hook connection 50 connecting first clamping element 52 to second clamping element 54. The clamping assembly is tightened about the pipe by set screw 56, which passes through overlapping portions of elements 52 and 54. Further, the clamping assembly could include a hinge, for example at location 58, to allow a clamping element to pivot open to assist in installation about the pipe. Where the clamping assembly includes a hinge, the clamping assembly may comprise only a single clamping element which fully circumscribes the pipe.

The above embodiments have been described by way of illustration only, and are not intended to limit the scope of the invention in any manner. The invention is intended to include any alternative or equivalent embodiments of the invention that may readily be envisioned by one of skill in the art, so long as the alternatives remain within the spirit and scope of the invention as above-described and as further set forth in the following claims:

What is claimed is:

1. A sprinkler head mounting assembly for attaching a sprinkler head to a pipe, the pipe having a longitudinal axis and a peripheral surface with at least one opening in the peripheral surface such that fluid may flow through the pipe and be distributed through the opening and expelled through said sprinkler head, said sprinkler head mounting assembly comprising:

a sprinkler head stem connected to said sprinkler head, said stem of appropriate size to fit into the opening in the peripheral surface of the pipe substantially perpendicular to the longitudinal axis of the pipe, said stem being sufficient to deliver fluid from the pipe to said sprinkler head;

a flange connected to said sprinkler head stem;

a first clamp portion having a first end and a second end, said first clamp portion being substantially curved to approximate the curvature of the pipe so that said first clamp portion will fit around a section of the peripheral surface of the pipe, said first and second ends of said first clamp portion being hooked;

an opening within said first clamp portion whereby said flange is held by said first clamp portion such that said first clamp portion may be used to affix said sprinkler head to the opening of the pipe; and a second clamp portion having a first end and a second end, said second clamp portion being designed to fit around the section of the peripheral surface of the pipe that is not covered by said first clamp portion, said first and second ends of said second clamp portion being hooked in an opposite manner from said first and second ends of said first clamp portion such that the ends of said first and second clamp portions will join together forming a substantially secure connection.

2. The sprinkler head mounting assembly of claim 1 further comprising means for tightening the connection between said first clamp portion and said second clamp portion.

3. The sprinkler head mounting assembly of claim 2 wherein said connection tightening means comprises a screw through said second clamp portion substantially perpendicular to the longitudinal axis of the pipe, such that turning said screw in one direction will cause said second clamp portion to move away from the peripheral surface of the pipe, thereby creating stress on the hook connections on said ends of said first and second clamp portions which tightens said connections.

4. The sprinkler head mounting assembly of claim 1 further comprising a gasket placed around said sprinkler head stem and located near the peripheral surface of the pipe to prevent fluid leakage from the opening in the pipe peripheral surface.

5. The sprinkler head mounting assembly of claim 1 wherein said opening within said first clamp portion comprises a slot such that said first end of said first clamp portion comprises at least two separate extended portions separated by said slot, whereby said sprinkler head stem fits within said slot while said slot is smaller than said flange so that said extended portions hold said flange.

6. A sprinkler head mounting assembly for attaching a sprinkler head to a pipe, the pipe having a longitudinal axis and a peripheral surface with at least one opening in the peripheral surface such that fluid may flow through the pipe and be distributed through the opening and expelled through said sprinkler head, said sprinkler head mounting assembly comprising:

an unthreaded sprinkler head stem connected to said sprinkler head, said stem of appropriate size to fit into the opening in the peripheral surface of the pipe substantially perpendicular to the longitudinal axis of the pipe, said stem being sufficient to deliver fluid from the pipe to said sprinkler head;

a flange connected to said sprinkler head stem; and means for securing said sprinkler head stem within the opening thereby providing fluid communication between said sprinkler head and the pipe, wherein said securing means engages said flange to hold said sprinkler head stem within the opening.

7. The sprinkler head mounting assembly of claim 6 wherein said securing means comprises:

a first clamp portion having a first end and a second end, said first clamp portion being substantially curved to approximate the curvature of the pipe so that said first clamp portion will fit around a section of the peripheral surface of the pipe, said first and second ends of said first clamp portion being hooked;

an opening within said first clamp portion whereby said flange is held by said first clamp portion such that said first clamp portion may be used to affix said sprinkler head to the opening of the pipe; and a second clamp portion having a first end and a second end, said second clamp portion being designed to fit around the section of the peripheral surface of the pipe that is not covered by said first clamp portion, said first and second ends of said second clamp portion being hooked in an opposite manner from said first and second ends of said first clamp portion such that the ends of said first and second clamp portions will join together forming a substantially secure connection.

8. The sprinkler head mounting assembly of claim 6 wherein said securing means comprises a single clamping element capable of circumscribing the peripheral surface of the pipe, said clamping element comprising:

a first and second end, each such end capable of being connected to the other end such that said clamping element will circumscribe an enclosed area;

an opening within said clamping element that is wide enough for said stem to pass through, but not as wide as said flange, so that said stem may be placed within said opening within said clamping element such that said flange is placed within the enclosed area; and means for tightening said clamping element such that said flange will be held in place thereby securing said stem within the opening of the pipe.

9. The sprinkler head mounting assembly of claim 8 wherein said tightening means comprises a screw through said second clamp portion substantially perpendicular to the longitudinal axis of the pipe, such that turning said screw in one direction will cause said second clamp portion to move away from the peripheral surface of the pipe, thereby creating stress on the hook connections on said ends of said first and second clamp portions which tightens said connections.

10. The sprinkler head mounting assembly of claim 6 further comprising a gasket placed around said sprinkler head stem and located near the peripheral surface of the pipe to reduce fluid leakage from the opening in the pipe peripheral surface.

11. A sprinkler head mounting assembly for attaching a sprinkler head to a pipe, the pipe having a longitudinal axis and a peripheral surface with at least one opening in the peripheral surface such that fluid may flow through the pipe and be distributed through the opening and expelled through said sprinkler head, said sprinkler head mounting assembly comprising:

an unthreaded sprinkler head stem connected to said sprinkler head, said stem of appropriate size to fit into the opening in the peripheral surface of the pipe substantially perpendicular to the longitudinal axis of the pipe, said stem being sufficient to deliver fluid from the pipe to said sprinkler head;

means rigidly affixed to said stem; and means for securing said sprinkler head stem within the opening thereby providing fluid communication between said sprinkler head and the pipe, said securing means engaging said rigidly affixed means to hold said sprinkler head stem within the opening.

12. The sprinkler head mounting assembly of claim 11 wherein said rigidly affixed means comprises a flange.

13. The sprinkler head mounting assembly of claim 12 wherein said securing means comprises:

a first clamp portion having a first end and a second end, said first clamp portion being designed to fit around a section of the peripheral surface of the pipe;

an opening within said first clamp portion whereby said flange is held by said first clamp portion such that said first clamp portion may be used to affix said sprinkler head stem to the opening of the pipe; and a second clamp portion having a first end and a second end, said second clamp portion being designed to fit around the section of the peripheral surface of the pipe that is not covered by said first clamp portion, said first and second ends of said second clamp portion being adapted to engage said first and second ends of said first clamp portion to form a substantially secure connection about the pipe.

14. The sprinkler head mounting assembly of claim 11 wherein said securing means comprises a first clamp portion designed to fit around a section of the peripheral surface of the pipe and affix said sprinkler head stem to the opening of the pipe.

15. The sprinkler head mounting assembly of claim 14 wherein said securing means further comprises a second clamp portion designed to fit around the section of the peripheral surface of the pipe that is not covered by said first clamp portion, said second clamp portion being adapted to engage said first clamp portion to form a substantially secure connection about the pipe.

* * * * *